US009338574B2

(12) United States Patent
Jax et al.

(10) Patent No.: US 9,338,574 B2
(45) Date of Patent: May 10, 2016

(54) METHOD AND APPARATUS FOR CHANGING THE RELATIVE POSITIONS OF SOUND OBJECTS CONTAINED WITHIN A HIGHER-ORDER AMBISONICS REPRESENTATION

(75) Inventors: Peter Jax, Hannover (DE); Johann-Markus Batke, Hannover (DE)

(73) Assignee: THOMSON LICENSING, Issy-les Moulineaux (FR)

( * ) Notice: Subject to any disclaimer, the term of this patent is extended or adjusted under 35 U.S.C. 154(b) by 61 days.

(21) Appl. No.: 14/130,074

(22) PCT Filed: Jun. 15, 2012

(86) PCT No.: PCT/EP2012/061477

§ 371 (c)(1),
(2), (4) Date: Dec. 30, 2013

(87) PCT Pub. No.: WO2013/000740

PCT Pub. Date: Jan. 3, 2013

(65) Prior Publication Data

US 2014/0133660 A1 May 15, 2014

(30) Foreign Application Priority Data

Jun. 30, 2011 (EP) ..... 11305845

(51) Int. Cl.

| | |
|---|---|
| ***H04S 5/00*** | (2006.01) |
| ***G10L 21/00*** | (2013.01) |
| ***H04S 3/00*** | (2006.01) |

(52) U.S. Cl.

CPC . *H04S 5/00* (2013.01); *G10L 21/00* (2013.01); *H04S 3/002* (2013.01); *H04R 2205/024* (2013.01); *H04S 2400/11* (2013.01); *H04S 2420/11* (2013.01)

(58) Field of Classification Search

None

See application file for complete search history.

(56) References Cited

U.S. PATENT DOCUMENTS

| | | | |
|---|---|---|---|
| 4,414,430 | A | 11/1983 | Gerzon et al. |
| 6,201,175 | B1 | 3/2001 | Kikomoto |

(Continued)

FOREIGN PATENT DOCUMENTS

| | | |
|---|---|---|
| CN | 1527284 | 9/2004 |
| CN | 1589127 | 3/2005 |

(Continued)

OTHER PUBLICATIONS

Noisternig, et al., "A 3D Ambisonic Based Binaural Sound Reproduction System", AES 24th International Conference on Multichannel Audio, Banff, Alberta, Canada, Jun. 26, 2003, pp. 1-5.

(Continued)

*Primary Examiner* — Brenda Bernardi

(74) *Attorney, Agent, or Firm* — Robert D. Shedd; Jerome G. Schaefer

(57) ABSTRACT

Higher-order Ambisonics HOA is a representation of spatial sound fields that facilitates capturing, manipulating, recording, transmission and playback of complex audio scenes with superior spatial resolution, both in 2D and 3D. The sound field is approximated at and around a reference point in space by a Fourier-Bessel series. The invention uses space warping for modifying the spatial content and/or the reproduction of sound-field information that has been captured or produced as a higher-order Ambisonics representation. Different warping characteristics are feasible for 2D and 3D sound fields. The warping is performed in space domain without performing scene analysis or decomposition. Input HOA coefficients with a given order are decoded to the weights or input signals of regularly positioned (virtual) loudspeakers.

14 Claims, 3 Drawing Sheets

(56) References Cited

U.S. PATENT DOCUMENTS

Figure 1:
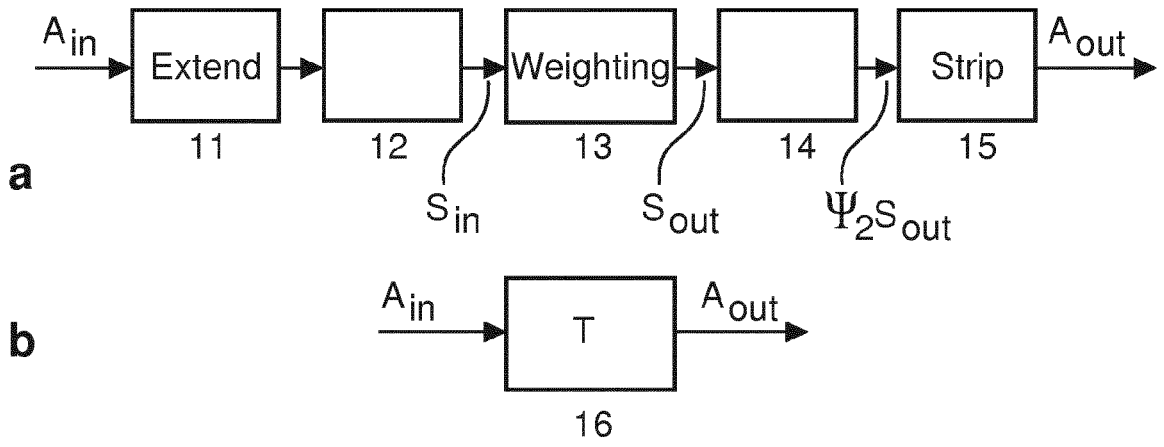

| | | | | |
|---|---|---|---|---|
| 6,694,033 | B1 * | 2/2004 | Rimell et al. | 381/307 |
| 7,394,904 | B2 | 7/2008 | Bruno et al. | |
| 9,326,934 | | 12/2009 | Kojiro | |
| 7,706,543 | B2 | 4/2010 | Daniel | |
| 9,100,768 | B2 | 8/2015 | Batke et al. | |
| 9,113,281 | B2 | 8/2015 | Jin et al. | |
| 2005/0157894 | A1 * | 7/2005 | Andrews et al. | 381/307 |
| 2008/0153840 | A1 | 6/2008 | Belardinelli et al. | |
| 2012/0014527 | A1 * | 1/2012 | Furse | 381/17 |

FOREIGN PATENT DOCUMENTS

| | | |
|---|---|---|
| JP | 199257500268 | 2/1992 |
| JP | 2002505058 | 2/2002 |
| JP | 2005519502 | 6/2005 |
| JP | 2006506918 | 2/2006 |
| JP | 2010252220 | 11/2010 |
| JP | 2013507796 | 3/2013 |
| JP | 2010514696 | 4/2013 |
| JP | 2013524564 | 6/2013 |
| WO | WO2004056298 | 7/2004 |
| WO | WO2006006809 | 1/2006 |
| WO | WO2008146466 | 12/2008 |

OTHER PUBLICATIONS

Poletti, M. A., "A Unified Theory of Horizontal Holographic Sound Systems", Journal of Audio Eng. Soc., vol. 48, No. 12, Dec. 2000, pp. 1155-1182.

Pomberger et al., "An Ambisonics Format for Flexible Playback Layouts", 2009 Ambisonics Symposium, Graz, Austria, Jun. 25, 2009, pp. 1-8.

Chapman M and Cotterell P. Towards a comprehensive account of valid ambisonic transformations, Ambisonics Symposium 2009, Jun. 25-27, 2009, Graz, Austria.

Poletti, M. A., Three-Dimensional surround sound systems based on spherical harmonics, J Audio Eng Soc., vol. 53, No. 11, Nov. 2005.

Pomberger H and Zolter F; Warping cit 3D ambisonic recordings, Ambisonics Symposium 2011, Jun. 2-3, 2011, Lexington, KY.

Barton et al., "Ambisonic Decoders tor HDTV", AES Convention Mar. 24, 1992.

Daniel J. "Représentation de champs acoustiques application à la transmission et à lla reproduction de sceènes sonores complexes dans un contexte multimédia", PhD theses, Université de Paris, Jul. 31, 2001.

Search Report Dated Jul. 20, 2012.

Bronstein I. N. etal, Taschenbuch der Mathematik, Verlag Harri Deutsch, Thun und Frankfurt/M, 2000.

Kappelan M, Eigenschaften von Allpass-Ketten und ihre Anwendung bei der nicht-äquidistanten spektralen Analyse and Synthese, PhD thesis, Aachen University (RWTH), Aachen, Germany, Feb. 1998.

Scharf L. L., Statistical Signal Processing. Detection. Estimation and Time Series Analysis. Addison-Wesley Publishing Company, Reading, Massachusetts, 1990.

MT_CN1527284, Patent Order, Wudi Sci Tech Co, Ltd., Jul. 8, 2015.

* cited by examiner

METHOD AND APPARATUS FOR CHANGING THE RELATIVE POSITIONS OF SOUND OBJECTS CONTAINED WITHIN A HIGHER-ORDER AMBISONICS REPRESENTATION

This application claims the benefit, under 35 U.S.C. §365 of International Application PCT/EP2012/061477, filed Jun. 15, 2012, which was published in accordance with PCT Article 21(2) on Jan. 3, 2013 in English and which claims the benefit of European patent application No. 11305845.7, filed Jun. 30, 2011.

The invention relates to a method and to an apparatus for changing the relative positions of sound objects contained within a two-dimensional or a three-dimensional Higher-Order Ambisonics representation of an audio scene.

BACKGROUND

Higher-order Ambisonics (HOA) is a representation of spatial sound fields that facilitates capturing, manipulating, recording, transmission and playback of complex audio scenes with superior spatial resolution, both in 2D and 3D. The sound field is approximated at and around a reference point in space by a Fourier-Bessel series.

There exist only a limited number of techniques for manipulating the spatial arrangement of an audio scene captured with HOA techniques. In principle, there are two ways:

A) Decomposing the audio scene into separate sound objects and associated position information, e.g. via DirAC, and composing a new scene with manipulated position parameters. The disadvantage is that sophisticated and error-prone scene decomposition is mandatory.

B) The content of the HOA representation can be modified via linear transformation of HOA vectors. Here, only rotation, mirroring, and emphasis of front/back directions have been proposed. All of these known, transformation-based modification techniques keep fixed the relative positioning of objects within a scene.

For manipulating or modifying a scene's contents, space warping has been proposed, including rotation and mirroring of HOA sound fields, and modifying the dominance of specific directions:

G. J. Barton, M. A. Gerzon, "Ambisonic Decoders for HDTV", AES Convention, 1992;

J. Daniel, "Représentation de champs acoustiques, application à la transmission et à la reproduction de scènes sonores complexes dans un contexte multimédia", PhD thesis, Université de Paris 6, 2001, Paris, France;

M. Chapman, Ph. Cotterell, "Towards a Comprehensive Account of Valid Ambisonic Transformations", Ambisonics Symposium, 2009, Graz, Austria.

INVENTION

A problem to be solved by the invention is to facilitate the change of relative positions of sound objects contained within a HOA-based audio scene, without the need for analysing the composition of the scene. This problem is solved by the method disclosed in claim 1. An apparatus that utilises this method is disclosed in claim 2.

The invention uses space warping for modifying the spatial content and/or the reproduction of sound-field information that has been captured or produced as a higher-order Ambisonics representation. Spatial warping in HOA domain represents both, a multi-step approach or, more computationally efficient, a single-step linear matrix multiplication. Different warping characteristics are feasible for 2D and 3D sound fields.

The warping is performed in space domain without performing scene analysis or decomposition. Input HOA coefficients with a given order are decoded to the weights or input signals of regularly positioned (virtual) loudspeakers.

The inventive space warping processing has several advantages:

- it is very flexible because of several degrees of freedom in parameterisation;
- it can be implemented in a very efficient manner, i.e. with a comparatively low complexity;
- it does not require any scene analysis or decomposition.

In principle, the inventive method is suited for changing the relative positions of sound objects contained within a two-dimensional or a three-dimensional Higher-Order Ambisonics HOA representation of an audio scene, wherein an input vector $A_{in}$ with dimension $O_{in}$ determines the coefficients of a Fourier series of the input signal and an output vector $A_{out}$ with dimension $O_{out}$ determines the coefficients of a Fourier series of the correspondingly changed output signal, said method including the steps:

decoding said input vector $A_{in}$ of input HOA coefficients into input signals $s_{in}$ in space domain for regularly positioned loudspeaker positions using the inverse $\Psi_1^{-1}$ of a mode matrix $\Psi_1$ by calculating $s_{in}=\Psi_1^{-1}A_{in}$;

warping and encoding in space domain said input signals $s_{in}$ into said output vector $A_{out}$ of adapted output HOA coefficients by calculating $A_{out}=\Psi_2 s_{in}$, wherein the mode vectors of the mode matrix $\Psi_2$ are modified according to a warping function $f(\phi)$ by which the angles of the original loudspeaker positions are one-to-one mapped into the target angles of the target loudspeaker positions in said output vector $A_{out}$.

In principle the inventive apparatus is suited for changing the relative positions of sound objects contained within a two-dimensional or a three-dimensional Higher-Order Ambisonics HOA representation of an audio scene, wherein an input vector $A_{in}$ with dimension $O_{in}$ determines the coefficients of a Fourier series of the input signal and an output vector $A_{out}$ with dimension $O_{out}$ determines the coefficients of a Fourier series of the correspondingly changed output signal, said apparatus including:

means being adapted for decoding said input vector $A_{in}$ of input HOA coefficients into input signals $s_{in}$ in space domain for regularly positioned loudspeaker positions using the inverse $\Psi_1^{-1}$ of a mode matrix $\Psi_1$ by calculating $s_{in}=\Psi_1^{-1}A_{in}$;

means being adapted for warping and encoding in space domain said input signals $s_{in}$ into said output vector $A_{out}$ of adapted output HOA coefficients by calculating $A_{out}=\Psi_2 S_{in}$, wherein the mode vectors of the mode matrix $\Psi_2$ are modified according to a warping function $f(\phi)$ by which the angles of the original loudspeaker positions are one-to-one mapped into the target angles of the target loudspeaker positions in said output vector $A_{out}$.

Advantageous additional embodiments of the invention are disclosed in the respective dependent claims.

DRAWINGS

Figure 2:
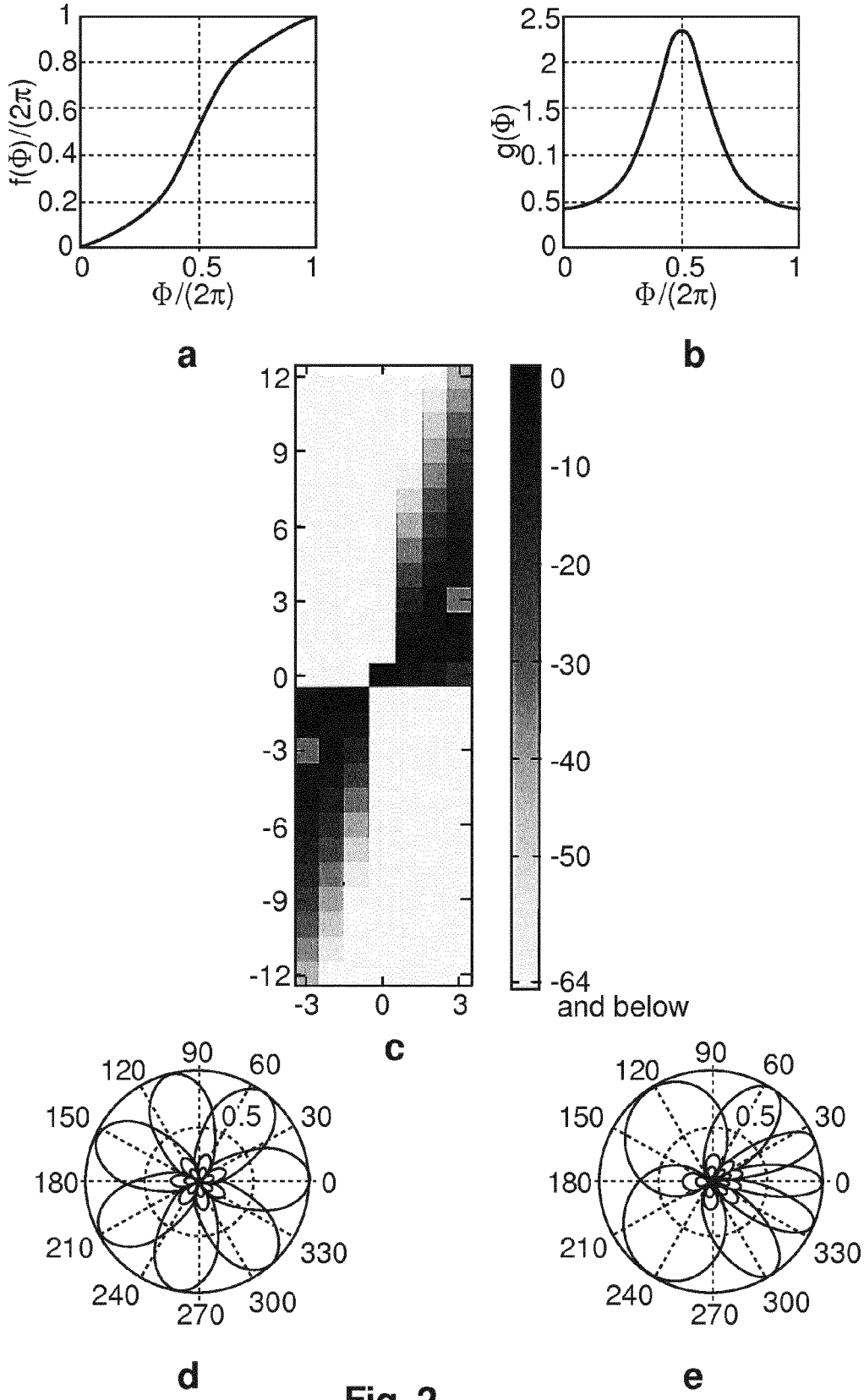
Figure 3:
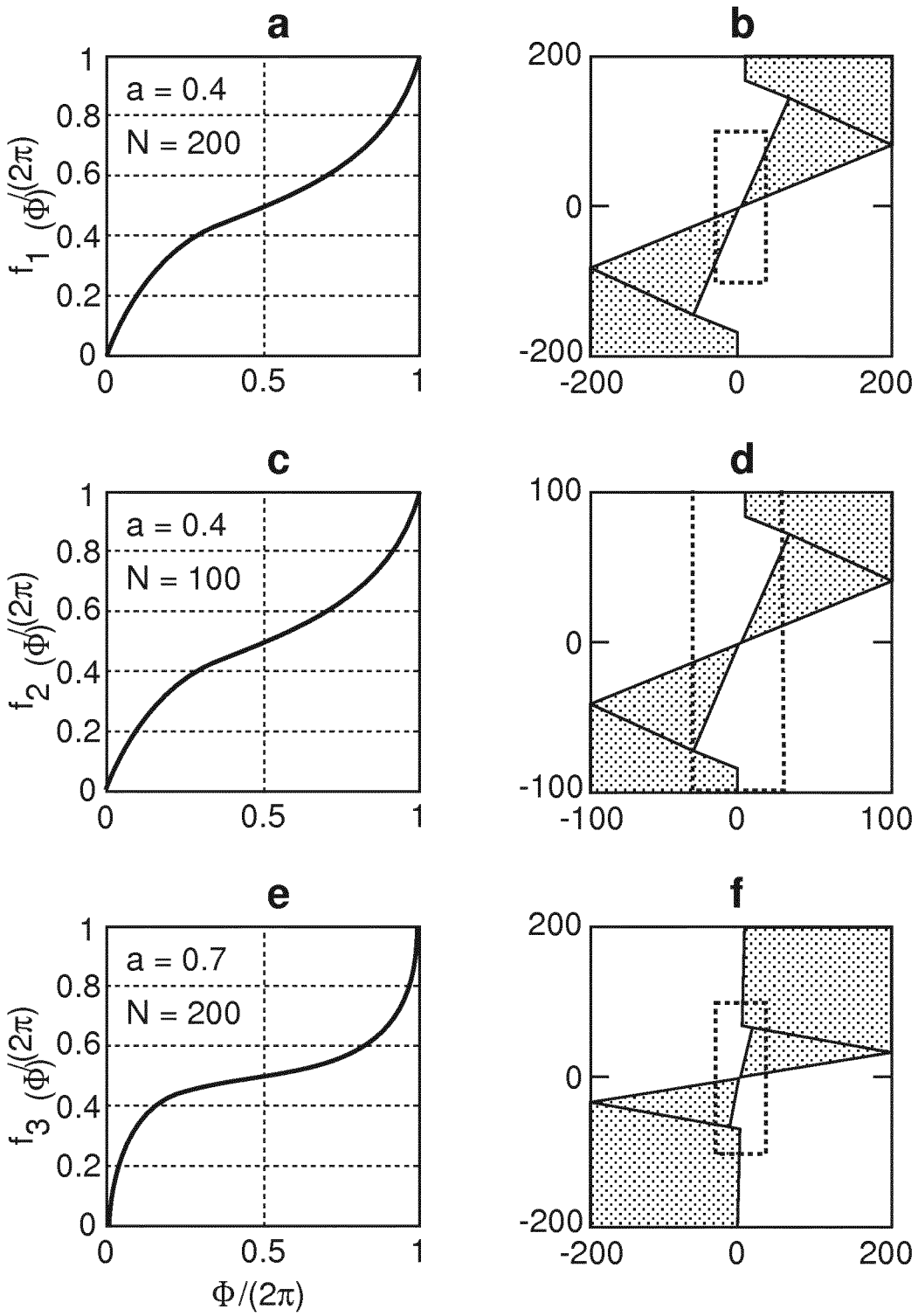

Exemplary embodiments of the invention are described with reference to the accompanying drawings, which show in:

FIG. 1 principle of warping in space domain;

FIG. 2 example of space warping with $N_{in}=3$, $N_{out}=12$ and the warping function $$f(\phi) = \phi + 2\text{atan}\left(\frac{a\sin\phi}{1 - a\cos\phi}\right)$$

with a=−0.4;

FIG. 3 matrix distortions for different warping functions and 'inner' orders $N_{warp}$.

EXEMPLARY EMBODIMENTS

In the sequel, for comprehensibility the inventive application of space warping is described for a two-dimensional setup, the HOA representation relies on circular harmonics, and it is assumed that the represented sound field comprises only plane sound waves. Thereafter the description is extended to three-dimensional cases, based on spherical harmonics.

Notation

In Ambisonics theory the sound field at and around a specific point in space is described by a truncated Fourier-Bessel series. In general, the reference point is assumed to be at the origin of the chosen coordinate system. For a three-dimensional application using spherical coordinates, the Fourier series with coefficients $A_n^m$ for all defined indices n=0, 1, . . . , N and m=−n, . . . , n describe the pressure of the sound field at azimuth angle $\phi$, inclination $\theta$ and distance r from the origin:

$$p(r,\theta,\phi)=\Sigma_{n=O}^{N}\Sigma_{m=-n}^{n}C_n^m j_n(kr)Y_n^m(\theta,\phi), \quad (1)$$

wherein k is the wave number and $j_n(kr)Y_n^m(\phi,\theta)$ is the kernel function of the Fourier-Bessel series that is strictly related to the spherical harmonic for the direction defined by $\theta$ and $\phi$. For convenience, in the sequel HOA coefficients $A_n^m$ are used with the definition $A_n^{m=C_n^m} j_n(kr)$. For a specific order N the number of coefficients in the Fourier-Bessel series is $O=(N+1)^2$.

For a two-dimensional application using circular coordinates, the kernel functions depend on the azimuth angle $\phi$ only. All coefficients with $m\neq n$ have a value of zero and can be omitted. Therefore, the number of HOA coefficients is reduced to only O=2N+1. Moreover, the inclination $\theta=\pi/2$ is fixed. Note that for the 2D case and for a perfectly uniform distribution of the sound objects on the circle, i.e. with $$\phi_i = i\frac{2\pi}{o},$$

the mode vectors within $\Psi$ are identical to the kernel functions of the well-known discrete Fourier transform DFT.

Different conventions exist for the definition of the kernel functions which also leads to different definitions of the Ambisonics coefficients $A_n^m$. However, the precise definition does not play a role for the basic specification and characteristics of the space warping techniques described in this application.

The HOA 'signal' comprises a vector A of Ambisonics coefficients for each time instant. For a two-dimensional—i.e. a circular—setting the typical composition and ordering of the coefficient vector is $$A_{2D}=(A_N^{-N},A_{N-1}^{-N+1},\ldots,A_1^{-1},A_O^O,A_1^1,\ldots,A_N^N)^T. \quad (2)$$

For a three-dimensional, spherical setting the usual ordering of the coefficients is different:

$$A_{3D}=(A_O^O,A_1^{-1},A_1^O,A_1^1,A_2^{-2},\ldots,A_N^N)^T. \quad (3)$$

The encoding of HOA representations behaves in a linear way and therefore the HOA coefficients for multiple, separate sound objects can be summed up in order to derive the HOA coefficients of the resulting sound field.

Plain Encoding

Plain encoding of multiple sound objects from several directions can be accomplished straight-forwardly in vector algebra. 'Encoding' means the step to derive the vector of HOA coefficients A(k,l) at a time instant l and wave number k from the information on the pressure contributions $s_i(k,l)$ of individual sound objects (i=0 . . . M−1) at the same time instant l, plus the directions $\phi_i$ and $\theta_i$ from which the sound waves are arriving at the origin of the coordinate system $$A(k,l)=\Psi\cdot s(k,l). \quad (4)$$

If a two-dimensional setup and a composition of HOA vectors as defined in equation (2) is assumed, the mode matrix $\Psi$ is constructed from mode vectors $Y(\phi)=(Y_N^{-N}, \ldots Y_O^O, \ldots, Y_N^N)^T$. The i-th column of $\Psi$ contains the mode vector according to the direction $\phi_i$ of the i-th sound object $$\Psi(Y(\phi_O),Y(\phi_1),\ldots,Y(\phi_{M-1})). \quad (5)$$

As defined above, encoding of a HOA representation can be interpreted as a space-frequency transformation because the input signals (sound objects) are spatially distributed. This transformation by the matrix $\Psi$ can be reversed without information loss only if the number of sound objects is identical to the number of HOA coefficients, i.e. if M=O, and if the directions $\phi_i$ are reasonably spread around the unit circle. In mathematical terms, the conditions for reversibility are that the mode matrix $\Psi$ must be square (O×O) and invertible.

Plain Decoding

By decoding, the driver signals of real or virtual loudspeakers are derived that have to be applied in order to precisely play back the desired sound field as described by the input HOA coefficients. Such decoding depends on the number M and positions of loudspeakers. The three following important cases have to be distinguished (remark: these cases are simplified in the sense that they are defined via the 'number of loudspeakers', assuming that these are set up in a geometrically reasonable manner. More precisely, the definition should be done via the rank of the mode matrix of the targeted loudspeaker setup). In the exemplary decoding rules shown below, the mode matching decoding principle is applied, but other decoding principles can be utilised which may lead to different decoding rules for the three scenarios.

Overdetermined case: The number of loudspeakers is higher than the number of HOA coefficients, i.e. M>O. In this case, no unique solution to the decoding problem exists, but a range of admissible solutions exist that are located in an M-O-dimensional sub-space of the M-dimensional space of all potential solutions. Typically, the pseudo inverse of the mode matrix $\Psi$ of the specific loudspeaker setup is used in order to determine the loudspeaker signals $$s,s=\Psi^T(\Psi\Psi^T)^{-1}A. \quad (6)$$

This solution delivers the loudspeaker signals with the minimal gross playback power $s^T s$ (see e.g. L. L. Scharf, "Statistical Signal Processing. Detection, Estimation, and Time Series Analysis", Addison-Wesley Publishing Company, Reading, Mass., 1990). For regular setups of the loudspeakers (which is easily achievable in the 2D case) the matrix operation $(\Psi\Psi^T)^{-1}$ yields the identity matrix, and the decoding rule from Eq. (6) simplifies to $s=\Psi^T A$.

Determined case: The number of loudspeakers is equal to the number of HOA coefficients. Exactly one unique solution to the decoding problem exists, which is defined by the inverse $\Psi^{-1}$ of the mode matrix $$\Psi: s=\Psi^{-1}A. \tag{7}$$

Underdetermined case: The number M of loudspeakers is lower than the number O of HOA coefficients. Thus, the mathematical problem of decoding the sound field is underdetermined and no unique, precise solution exists. Instead, numerical optimisation has to be used for determining loudspeaker signals that best possibly match the desired sound field.

Regularisation can be applied in order to derive a stable solution, for example by the formula $$s=\Psi^T(\Psi\Psi^T+\lambda I)^{-1}A, \tag{8}$$

wherein I denotes the identity matrix and the scalar factor $\lambda$ defines the amount of regularisation. As an example $\lambda$ can be set to the average of the eigenvalues of $\Psi\Psi^T$.

The resulting beam patterns may be sub-optimal because in general the beam patterns obtained with this approach are overly directional, and a lot of sound information will be underrepresented.

For all decoder examples described above the assumption was made that the loudspeakers emit plane waves. Real-world loudspeakers have different playback characteristics, which characteristics the decoding rule should take care of.

Basic Warping

The principle of the inventive space warping is illustrated in FIG. 1*a*. The warping is performed in space domain. Therefore, first the input HOA coefficients $A_{in}$ with order $N_{in}$ and dimension $O_{in}$ are decoded in step/stage 12 to the weights or input signals $s_{in}$ for regularly positioned (virtual) loudspeakers. For this decoding step it is advantageous to apply a determined decoder, i.e. one for which the number $O_{warp}$ of virtual loudspeakers is equal to or larger than the number of HOA coefficients $O_{in}$. For the latter case (more loudspeakers than HOA coefficients), the order or dimension of the vector $A_{in}$, of HOA coefficients can easily be extended by adding in step/stage 11 zero coefficients for higher orders. The dimension of the target vector $s_{in}$ will be denoted by $O_{warp}$ in the sequel.

The decoding rule is $$s_{in}=\Psi_1^{-1}A_{in}. \tag{9}$$

The virtual positions of the loudspeaker signals should be regular, e.g. $\phi_i=i\cdot 2\pi/O_{warp}$ for the two-dimensional case. Thereby it is guaranteed that the mode matrix $\Psi_1$ is well-conditioned for determining the decoding matrix $\Psi_1^{-1}$. Next, the positions of the virtual loudspeakers are modified in the 'warp' processing according to the desired warping characteristics. That warp processing is in step/stage 14 combined with encoding the target vector $s_{in}$ (or $s_{out}$, respectively) using mode matrix $\Psi_2$, resulting in vector $A_{out}$ of warped HOA coefficients with dimension $O_{warp}$ or, following a further processing step described below, with dimension $O_{out}$. In principle, the warping characteristics can be fully defined by a one-to-one mapping of source angles to target angles, i.e. for each source angle $\phi_{in}=0 \ldots 2\pi$ and possibly $\theta_{in}=0 \ldots 2\pi$ a target angle is defined, whereby for the 2D case $$\phi_{out}=f(\phi_{in}) \tag{10}$$

and for the 3D case $$\phi_{out}=f_\phi(\phi_{in},\theta_{in}) \tag{11}$$

$$\theta_{out}=f_\theta(\phi_{in},\theta_{in}). \tag{12}$$

For comprehension, this (virtual) re-orientation can be compared to physically moving the loudspeakers to new positions.

One problem that will be produced by this procedure is that the distance between adjacent loudspeakers at certain angles is altered according to the gradient of the warping function $f(\phi)$ (this is described for the 2D case in the sequel): if the gradient of $f(\phi)$ is greater than one, the same angular space in the warped sound field will be occupied by less 'loudspeakers' than in the original sound field, and vice versa. In other words, the density $D_s$ of loudspeakers behaves according to $$D_s(\phi)=\frac{1}{\frac{df(\phi)}{d\phi}}. \tag{13}$$

In turn, this means that space warping modifies the sound balance around the listener. Regions in which the loudspeaker density is increased, i.e. for which $D_s(\phi)>1$, will become more dominant, and regions in which $D_s(\phi)<1$ will become less dominant.

As an option, depending on the requirements of the application, the aforementioned modification of the loudspeaker density can be countered by applying a gain function $g(\phi)$ to the virtual loudspeaker output signals $s_{in}$ in weighting step/stage 13, resulting in signal $s_{out}$. In principle, any weighting function $g(\phi)$ can be specified. One particular advantageous variant has been determined empirically to be proportional to the derivative of the warping function $f(\phi)$:

$$g(\phi)=\frac{1}{D_s(\phi)}=\frac{df(\phi)}{d\phi}. \tag{14}$$

With this specific weighting function, under the assumption of appropriately high inner order and output order (see the below section How to set the HOA orders), the amplitude of a panning function at a specific warped angle $f(\phi)$ is kept equal to the original panning function at the original angle $\phi$. Thereby, a homogeneous sound balance (amplitude) per opening angle is obtained.

Apart from the above example weighting function, other weighting functions can be used, e.g. in order to obtain an equal power per opening angle.

Finally, in step/stage 14 the weighted virtual loudspeaker signals are warped and encoded again with the mode matrix $\Psi_2$ by performing $\Psi_2 s_{out}$. $\Psi_2$ comprises different mode vectors than $\Psi_1$, according to the warping function $f(\phi)$. The result is an $O_{warp}$-dimension HOA representation of the warped sound field.

If the order or dimension of the target HOA representation shall be lower than the order of the encoder $\Psi_2$ (see the below section How to set the HOA orders), some of (i.e. a part of) the warped coefficients have to be removed (stripped) in step/stage 15. In general, this stripping operation can be described by a windowing operation: the encoded vector $\Psi_2 s_{out}$ is multiplied with a window vector w which comprises zero coefficients for the highest orders that shall be removed, which multiplication can be considered as representing a further weighting. In the simplest case, a rectangular window can be applied, however, more sophisticated windows can be used as described in section 3 of M. A. Poletti, "A Unified Theory of Horizontal Holographic Sound Systems", Journal of the Audio Engineering Society, 48(12), pp. 1155-1182, 2000, or the 'in-phase' or 'max. $r_E$' windows from section 3.3.2 of the above-mentioned PhD thesis of J. Daniel.

Warping Functions for 3D

The concept of a warping function $f(\phi)$ and the associated weighting function $g(\phi)$ has been described above for the two-dimensional case. The following is an extension to the three-dimensional case which is more sophisticated both because of the higher dimension and because spherical geometry has to be applied. Two simplified scenarios are introduced, both of which allow to specify the desired spatial warping by one-dimensional warping functions $f(\phi)$ or $f(\theta)$.

In space warping along longitudes, the space warping is performed as a function of the azimuth $\phi$ only. This case is quite similar to the two-dimensional case introduced above. The warping function is fully defined by $$\theta_{out}=f_\theta(\theta_{in},\phi_{in})\overset{!}{=}\theta_{in} \tag{15}$$

$$\phi_{out}=f_\phi(\theta_{in},\phi_{in})\overset{!}{=}f_\phi(\phi_{in}). \tag{16}$$

Thereby similar warping functions can be applied as for the two-dimensional case. Space warping has its maximum impact for sound objects on the equator, while it has the lowest impact to sound objects at the poles of the sphere.

The density of (warped) sound objects on the sphere depends only on the azimuth. Therefore the weighting function for constant density is $$g(\theta)=\frac{d f_\phi(\phi)}{d\phi}. \tag{17}$$

A free orientation of the specific warping characteristics in space is feasible by (virtually) rotating the sphere before applying the warping and reversely rotating afterwards.

In space warping along latitudes, the space warping is allowed only along meridians. The warping function is defined by $$\theta_{out}=f_\theta(\theta_{in},\phi_{in})\overset{!}{=}f_\theta(\theta_{in}) \tag{18}$$

$$\phi_{out}=f_\phi(\theta_{in},\phi_{in})\overset{!}{=}\phi_{in}. \tag{19}$$

An important characteristic of this warping function on a sphere is that, although the azimuth angle is kept constant, the angular distance of two points in azimuth-direction may well change due to the modification of the inclination. The reason is that the angular distance between two meridians is maximum at the equator, but it vanishes to zero at the two poles. This fact has to be accounted for by the weighting function.

The angular distance c of two points A and B can be determined by the cosine rule of spherical geometry, cf. Eq. (3.188c) in I. N. Bronstein, K. A. Semendjajew, G. Musiol, H. Mühlig, "Taschenbuch der Mathematik", Verlag Harri Deutsch, Thun, Frankfurt/Main, 5th edition, 2000:

$$\cos c=\cos\theta_A\cos\theta_B+\sin\theta_A\sin\theta_B\cos\phi_{AB}, \tag{20}$$

where $\phi_{AB}$ denotes the azimuth angle between the two points A and B. Regarding the angular distance between two points at the same inclination $\theta$, this equation simplifies to $$c=\arccos\left[(\cos\theta_A)^2+(\sin\theta_A)^2\cos\phi_\epsilon\right]. \tag{21}$$

This formula can be applied in order to derive the angular distance between a point in space and another point that is by a small azimuth angle $\phi_\epsilon$ apart. 'Small' means as small as feasible in practical applications but not zero, in theory the limiting value $\phi_\epsilon\to 0$. The ratio between such angular distances before and after warping gives the factor by which the density of sound objects in $\phi$-direction changes:

$$\frac{c_{out}}{c_{in}}=\frac{\arccos((\cos\theta_{out})^2+(\sin\theta_{out})^2\cos\phi_\varepsilon)}{\arccos((\cos\theta_{in})^2+(\sin\theta_{in})^2\cos\phi_\varepsilon)}. \tag{22}$$

Finally, the weighting function is the product of the two weighting functions in $\phi$-direction and in $\theta$-direction $$g(\theta,\phi)=\frac{d f_\theta(\theta)}{d\theta}\cdot\frac{\arccos((\cos f_\theta(\theta_{in}))^2+(\sin f_\theta(\theta_{in}))^2\cos\phi_\varepsilon)}{\arccos((\cos\theta_{in})^2+(\sin\theta_{in})^2\cos\phi_\varepsilon)}. \tag{23}$$

Again, as in the previous scenario, a free orientation of the specific warping characteristics in space is feasible by rotation.

Single-Step Processing

The steps introduced in connection with FIG. 1*a*, i.e. extension of order, decoding, weighting, warping+encoding and stripping of order, are essentially linear operations. Therefore, this sequence of operations can be replaced by multiplication of the input HOA coefficients with a single matrix in step/stage 16 as depicted in FIG. 1*b*. Omitting the extension and stripping operations, the full $O_{warp}\times O_{warp}$ transformation matrix T is determined as $$T=\mathrm{diag}(w)\Psi_2\mathrm{diag}(g)\Psi_1^{-1}, \tag{24}$$

where diag(·) denotes a diagonal matrix which has the values of its vector argument as components of the main diagonal, g is the weighting function, and w is the window vector for preparing the stripping described above, i.e., from the two functions of weighting for preparing the stripping and the coefficients-stripping itself carried out in step/stage 15, window vector w in equation (24) serves only for the weighting.

The two adaptions of orders within the multi-step approach, i.e. the extension of the order preceding the decoder and the stripping of HOA coefficients after encoding, can also be integrated into the transformation matrix T by removing the corresponding columns and/or lines. Thereby, a matrix of the size $O_{out}\times O_{in}$ in is derived which directly can be applied to the input HOA vectors. Then, the space warping operation becomes $$A_{out}=TA_{in}. \tag{25}$$

Advantageously, because of the effective reduction of the dimensions of the transformation matrix T from $O_{warp}\times O_{warp}$ to $O_{out}\times O_{in}$, the computational complexity required for performing the single-step processing according to FIG. 1*b* is significantly lower than that required for the multi-step approach of FIG. 1*a*, although the single-step processing delivers perfectly identical results. In particular, it avoids distortions that could arise if the multi-step processing is performed with a lower order $N_{warp}$ of its interim signals (see the below section How to set the HOA orders for details).

State-of-the-Art: Rotation and Mirroring

Rotations and mirroring of a sound field can be considered as 'simple' sub-categories of space warping. The special characteristic of these transforms is that the relative position of sound objects with respect to each other is not modified. This means, a sound object that has been located e.g. 30° to the right of another sound object in the original sound scene will stay 30° to right of the same sound object in the rotated sound scene. For mirroring, only the sign changes but the angular distances remain the same. Algorithms and applications for rotation and mirroring of sound field information have been explored and described e.g. in the above mentioned Barton/Gerzon and J. Daniel articles, and in M. Noisternig, A. Sontacchi, Th. Musil, R. Höldrich, "A 3D Ambisonic Based Binaural Sound Reproduction System", Proc. of the AES 24th Intl. Conf. on Multichannel Audio, Banff, Canada, 2003, and in H. Pomberger, F. Zotter, "An Ambisonics Format for Flexible Playback Layouts", 1st Ambisonics Symposium, Graz, Austria, 2009.

These approaches are based on analytical expressions for the rotation matrices. For example, rotation of a circular sound field (2D case) by an arbitrary angle $\alpha$ can be performed by multiplication with the warping matrix $T_\alpha$ in which only a subset of coefficients is non-zero:

$$T_\alpha(\mu, \nu) = \begin{cases} \cos(-\alpha(\mu - (O+1)/2); & \nu = \mu \\ \sin(-\alpha(\mu - (O+1)/2); & \nu = N - \mu + 1 \\ 0; & \text{otherwise.} \end{cases} \tag{26}$$

As in this example, all warping matrices for rotation and/or mirroring operations have the special characteristics that only coefficients of the same order n are affecting each other. Therefore these warping matrices are very sparsely populated, and the output $N_{out}$ can be equal to the input order $N_{in}$ without loosing any spatial information.

There are a number of interesting applications, for which rotating or mirroring of sound field information is required. One example is the playback of sound fields via headphones with a head-tracking system. Instead of interpolating HRTFs (head-related transfer function) according to the rotation angle(s) of the head, it is advantageous to pre-rotate the sound field according to the position of the head and to use fixed HRTFs for the actual playback. This processing has been described in the above mentioned Noisternig/Sontacchi/Musil/Höldrich article.

Another example has been described in the above mentioned Pomberger/Zotter article in the context of encoding of sound field information. It is possible to constrain the spatial region that is described by HOA vectors to specific parts of a circle (2D case) or a sphere. Due to the constraints some parts of the HOA vectors will become zero. The idea promoted in that article is to utilise this redundancy-reducing property for mixed-order coding of sound field information. Because the aforementioned constraints can only be obtained for very specific regions in space, a rotation operation is in general required in order to shift the transmitted partial information to the desired region in space.

EXAMPLE

FIG. 2 illustrates an example of space warping in the two-dimensional (circular) case. The warping function has been chosen to $$f(\phi) = \phi + 2\text{atan}\left(\frac{a\sin\phi}{1 - a\cos\phi}\right) \text{ with } a = -0.4, \tag{27}$$

which resembles the phase response of a discrete-time allpass filter with a single real-valued parameter, cf. M. Kappelan, "Eigenschaften von Allpass-Ketten und ihre Anwendung bei der nicht-äquidistanten spektralen Analyse und Synthese", PhD thesis, Aachen University (RWTH), Aachen, Germany, 1998.

The warping function is shown in FIG. 2*a*. This particular warping function $f(\phi)$ has been selected because it guarantees a $2\pi$-periodic warping function while it allows to modify the amount of spatial distortion with a single parameter a. The corresponding weighting function $g(\phi)$ shown in FIG. 2*b* deterministically results for that particular warping function.

FIG. 2*c* depicts the 7×25 single-step transformation warping matrix T. The logarithmic absolute values of individual coefficients of the matrix are indicated by the gray scale or shading types according to the attached gray scale or shading bar. This example matrix has been designed for an input HOA order of $N_\epsilon=3$ and an output order of $N_{out}=12$. The higher output order is required in order to capture most of the information that is spread by the transformation from low-order coefficients to higher-order coefficients. If the output order would be further reduced, the precision of the warping operation would be degraded because non-zero coefficients of the full warping matrix would be neglected (see the below section How to set the HOA orders for a more detailed discussion).

A very useful characteristic of this particular warping matrix is that large portions of it are zero. This allows to save a lot of computational power when implementing this operation, but it is not a general rule that certain portions of a single-step transformation matrix are zero.

FIG. 2*d* and FIG. 2*e* illustrate the warping characteristics at the example of beam patterns produced by some plane waves. Both figures result from the same seven input plane waves at $\phi$ positions 0, $2/7\pi$, $4/7\pi$, $6/7\pi$, $8/7\pi$, $10/7\pi$ and $12/7\pi$, all with identical amplitude of one, and show the seven angular amplitude distributions, i.e. the result vector s of the following overdetermined, regular decoding operation $$s = \Psi^{-1} A, \tag{28}$$

where the HOA vector A is either the original or the warped variant of the set of plane waves. The numbers outside the circle represent the angle $\phi$. The number (e.g. 360) of virtual loudspeakers is considerably higher than the number of HOA parameters. The amplitude distribution or beam pattern for the plane wave coming from the front direction is located at $\phi=0$.

FIG. 2*d* shows the amplitude distribution of the original HOA representation. All seven distributions are shaped alike and feature the same width of the main lobe. The maxima of the main lobes are located at the angles $\phi=(0, 2/7\pi, \ldots)$ of the original seven sound objects, as expected. The main lobes have widths corresponding to the limited order $N_{in}=3$ of the original HOA vectors.

FIG. 2*e* shows the amplitude distributions for the same sound objects, but after the warping operation has been performed. In general, the objects have moved towards the front direction of 0 degrees and the beam patterns have been modified: main lobes around the front direction $\phi=0$ have become narrower and more focused, while main lobes in the back direction around 180 degrees have become considerably wider. At the sides, with a maximum impact at 90 and 270 degrees, the beam patterns have become asymetric due to the large gradient of the FIG. 2*b* weighting function $g(\phi)$ for these angles. These considerable modifications (narrowing and reshaping) of beam patterns have been made possible by the higher order $N_{out}=12$ of the warped HOA vector. Theoretically, the resolution of main lobes in the front direction has been increased by a factor of 2.33, while the resolution in the back direction has been reduced by a factor of 1/2.33. A mixed-order signal has been created with local orders varying over space. It can be assumed that a minimum output order of $2.33 \cdot N_{in} \approx 7$ is required for representing the warped HOA coefficients with reasonable precision. In the below section How to set the HOA orders the discussion on intrinsic, local orders is more detailed.

Characteristics

The warping steps introduced above are rather generic and very flexible. At least the following basic operations can be accomplished: rotation and/or mirroring along arbitrary axes and/or planes, spatial distortion with a continuous warping function, and weighting of specific directions (spatial beamforming).

In the following sub-sections a number of characteristics of the inventive space warping are highlighted, and these details provide guidance on what can and what cannot be achieved. Furthermore, some design rules are described. In principle, the following parameters can be adjusted with some degree of freedom in order to obtain the desired warping characteristics:

Warp function $f(\theta,\phi)$;

Weighting function $g(\theta,\phi)$;

Inner order $N_{warp}$;

Output order $N_{out}$;

Windowing of the output coefficients with a vector w.

Linearity

The basic transformation steps in the multi-step processing are linear by definition. The non-linear mapping of sound sources to new locations taking place in the middle has an impact to the definition of the encoding matrix, but the encoding matrix itself is linear again. Consequently, the combined space warping operation and the matrix multiplication with T is a linear operation as well, i.e.

$$TA_1+TA_2=T(A_1+A_2). \tag{29}$$

This property is essential because it allows to handle complex sound field information that comprises simultaneous contributions from different sound sources.

Space-Invariance

By definition (unless the warping function is perfectly linear with gradient 1 or −1), the space warping transformation is not space-invariant. This means that the operation behaves differently for sound objects that are originally located at different positions on the hemisphere. In mathematical terms, this property is the result of the non-linearity of the warping function $f(\phi)$, i.e.

$$f(\phi+\alpha)\neq f(\phi)+\alpha \tag{30}$$

for at least some arbitrary angles $\alpha\in]0 \ldots 2\pi[$.

Reversibility

Typically, the transformation matrix T cannot be simply reversed by mathematical inversion. One obvious reason is that T normally is not square. Even a square space warping matrix will not be reversible because information that is typically spread from lower-order coefficients to higher-order coefficients will be lost (compare section How to set the HOA orders and the example in section Example), and loosing information in an operation means that the operation cannot be reversed.

Therefore, another way has to be found for at least approximately reversing a space warping operation. The reverse warping transformation $T_{rev}$ can be designed via the reverse function $f_{rev}(\cdot)$ of the warping function $f(\cdot)$ for which $$f_{rev}(f(\phi))=\phi. \tag{31}$$

Depending on the choice of HOA orders, this processing approximates the reverse transformation.

How to Set the HOA Orders

An important aspect to be taken into account when designing a space warping transformation are HOA orders. While, normally, the order $N_{in}$ of the input vectors $A_{in}$, are predefined by external constraints, both the order $N_{out}$ of the output vectors $A_{out}$ and the 'inner' order $N_{warp}$ of the actual non-linear warping operation can be assigned more or less arbitrarily. However, that both orders $N_{in}$ and $N_{warp}$ have to be chosen with care as explained below.

'Inner' Order $N_{warp}$:

The 'inner' order $N_{warp}$ defines the precision of the actual decoding, warping and encoding steps in the multi-step space warping processing described above. Typically, the order $N_{warp}$ should be considerably larger than both the input order $N_{in}$ and the output order $N_{out}$. The reason for this requirement is that otherwise distortions and artifacts will be produced because the warping operation is, in general, a non-linear operation.

To explain this fact, FIG. 3 shows an example of the full warping matrix for the same warping function as used for the example from FIG. 2. FIGS. 3*a*, 3*c* and 3*e* depict the warping functions $f_1(\phi)$, $f_2(\phi)$ and $f_3(\phi)$, respectively. FIGS. 3*b*, 3*d* and 3*f* depict the warping matrices $T_1$(dB), $T_2$(dB) and $T_3$(dB), respectively. For illustration reasons, these warping matrices have not been clipped in order to determine the warping matrix for a specific input order $N_{in}$ or output order $N_{out}$. Instead, the dotted lines of the centred box within FIGS. 3*b*, 3*d* and 3*f* depict the target size $N_{out}\times N_{in}$ of the final resulting, i.e. clipped transformation matrix. In this way the impact of non-linear distortions to the warping matrix is clearly visible. In the example, the target orders have been arbitrarily set to $N_{in}=30$ and $N_{out}=100$.

The basic challenge can be seen in FIG. 3*b*: it is obvious that due to the non-linear processing in space domain the coefficients within the warping matrix are spread around the main diagonal—the farther away from the centre of the matrix the more. At very high distances from the centre, in the example at about $|y|\geq 90$, y being the vertical axis, the coefficient spreading reaches the boundaries of the full matrix, where it seems to 'bounce off'. This creates a special kind of distortions which extend to a large portion of the warping matrix. In experimental evaluations it has been observed that these distortions significantly impair the transformation performance, as soon as distortion products are located within the target area of the matrix (marked by the dotted-line box in the figure).

For the first example in FIG. 3*b* everything works fine because the 'inner' order of the processing has been chosen to $N_{warp}=200$ which is considerably higher than the output order $N_{out}=100$. The region of distortions does not extend into the dotted-line box.

Another scenario is shown in FIG. 3*d*. The inner order has been specified to be equal to the output order, i.e. $N_{warp}=N_{out}=100$. The figure shows that the extension of the distortions scales linearly with the inner order. The result is that the higher-order coefficients of the output of the transformation is polluted by distortion products. The advantage of such scaling property is that it seems possible to avoid these kind of non-linear distortions by increasing the inner order $N_{warp}$ accordingly.

FIG. 3*f* shows an example with a more aggressive warping function with a larger coefficient a=0.7. Because of the more aggressive warping function the distortions now extend into the target matrix area even for the inner order of $N_{warp}$=200. For this case, as derived in the previous paragraph, the inner order should be further increased for even more over-provisioning. Experiments for this warping function show that increasing the inner order to for example N=400 removes these non-linear distortions.

In summary, the more aggressive the warping operation, the higher the inner order $N_{warp}$ should be. There exists no formal derivation of a minimum inner order yet. However, if in doubt, over-provisioning of 'inner' order is helpful because the non-linear effects are scaling linearly with the size of the full warping matrix. In principle, the 'inner' order can be arbitrarily high. In particular, if a single-step transformation matrix is to be derived, the inner order does not play any role for the complexity of the final warping operation.

Output Order $N_{out}$:

For specifying the output order $N_{out}$ of the warping transform, the following two aspects are to be considered:

- In general, the output order has to be larger than the input order $N_{in}$ in order to retain all information that is spread to coefficients of different orders. The actual required size depends as well on the characteristics of the warping function. As a rule of thumb, the less 'broadband' the warping function $f(\phi)$ the smaller the required output order. It appears that in some cases the warping function can be low-pass filtered in order to limit the required output order $N_{out}$.
- An example can be observed in FIG. 3*b*. For this particular warping function, an output order of $N_{out}$=100, as indicated by the dotted-line box, is sufficient to prevent information loss. If the output order would be reduced significantly, e.g. to $N_{out}$=50, some non-zero coefficients of the transformation matrix will be left out, and corresponding information loss is to be expected.
- In some cases, the output HOA coefficients will be used for a processing or a device which are capable of handling a limited order only. For example, the target may be a loudspeaker setup with limited number of speakers. In such applications the output order should be specified according to the capabilities of the target system.
- If $N_{out}$ is sufficiently small, the warping transformation effectively reduces spatial information.

The reduction of the inner order $N_{warp}$ to the output order $N_{out}$ can be done by mere dropping of higher-order coefficients. This corresponds to applying a rectangular window to the HOA output vectors. Alternatively, more sophisticated bandwidth reduction techniques can be applied like those discussed in the above-mentioned M. A. Poletti article or in the above-mentioned J. Daniel article. Thereby, even more information is likely to be lost than with rectangular windowing, but superior directivity patterns can be accomplished.

The invention can be used in different parts of an audio processing chain, e.g. recording, post production, transmission, playback.

The invention claimed is:

1. A method for changing the relative positions of sound objects contained within a two-dimensional or a three-dimensional Higher-Order Ambisonics (HOA) representation of an audio scene, wherein an input vector $A_{in}$ with dimension $O_{in}$ determines the coefficients of a Fourier series of the input signal and an output vector $A_{out}$ with dimension $O_{out}$ determines the coefficients of a Fourier series of the correspondingly changed output signal, said method comprising:

decoding said input vector $A_{in}$ of input HOA coefficients into input signals $s_{in}$ in space domain for regularly positioned loudspeaker positions using a pseudo inverse of a mode matrix $\Psi_1$ by calculating $$s_{in} = \Psi^T(\Psi\,\Psi^T)^{-1}A_{in};$$

and warping and encoding in space domain said input signals $s_{in}$ into said output vector $A_{out}$ of adapted output HOA coefficients by calculating $A_{out}=\Psi_2 s_{in}$, wherein the mode vectors of the mode matrix $\Psi_2$ are modified with respect to the mode vectors of mode matrix $\Psi_1$ according to a warping function $f(\phi)$ by which the angles of the regularly positioned loudspeaker positions are one-to-one mapped into the target angles of the target loudspeaker positions in said output vector $A_{out}$.

2. The method of claim 1, wherein said space domain input signals $s_{in}$ are weighted by a gain function $g(\phi)$ or $g(\theta,\phi)$ prior to said warping and encoding.

3. The method of claim 2, wherein for two-dimensional Ambisonics said gain function is $$g(\phi) = \frac{df(\phi)}{d\phi},$$

and for three-dimensional Ambisonics said gain function is $g(\theta,\phi)$ $$g(\theta,\phi) = \frac{df_\theta(\theta)}{d\theta}\cdot\frac{\arccos((\cos f_\theta(\theta_{in}))^2 + (\sin f_\theta(\theta_{in}))^2\cos\phi_\varepsilon)}{\arccos((\cos\theta_{in})^2 + (\sin\theta_{in})^2\cos\phi_\varepsilon)}$$

in the $\phi$ direction and in the $\theta$ direction, wherein $\phi$ is the azimuth angle, $\theta$ is the inclination angle, $f_\theta(\theta)$ is warping function for three-dimensional Ambisonics and $\phi_\epsilon$ is a small azimuth angle.

4. The method of claim 1 wherein, in case the number or dimension $O_{warp}$ of virtual loudspeakers is equal or greater than the number or dimension $O_{in}$ of HOA coefficients, prior to said decoding the order or dimension of said input vector $A_{in}$ is extended by adding zero coefficients for higher orders.

5. The method of claim 2 wherein, in case the order or dimension of HOA coefficients is lower than the order or dimension of said mode matrix $\Psi_2$, said warped and encoded and possibly weighted signal $\Psi_2 s_{in}$ is further weighted using a window vector w comprising zero coefficients for the highest orders, for stripping part of the warped coefficients in order to provide said output vector $A_{out}$.

6. The method of claim 2, wherein said decoding, weighting and warping/decoding are commonly carried out by using a size $O_{warp}\times O_{warp}$ transformation matrix $T=\mathrm{diag}(w)\Psi_2\,\mathrm{diag}(g)\Psi_1^{-1}$, wherein diag(w) denotes a diagonal matrix which has the values of said window vector w as components of its main diagonal and diag(g) denotes a diagonal matrix which has the values of said gain function g as components of its main diagonal.

7. The method of claim 6 wherein, in order to shape said transformation matrix T so as to get a size $O_{out}\times O_{in}$, the corresponding columns and/or lines of said transformation matrix T are removed so as to perform the space warping operation $A_{out}=T\,A_{in}$.

8. An apparatus for changing the relative positions of sound objects contained within a two-dimensional or a three-dimensional Higher-Order Ambisonics (HOA) representation of an audio scene, wherein an input vector $A_{in}$ with dimension $O_{in}$ determines the coefficients of a Fourier series of the input signal and an output vector $A_{out}$ with dimension $O_{out}$ determines the coefficients of a Fourier series of the correspondingly changed output signal, said apparatus comprising:

a decoder which decodes said input vector $A_{in}$ of input HOA coefficients into input signals $s_{in}$ in space domain for regularly positioned loudspeaker positions using a pseudo inverse of a mode matrix $\Psi_1$ by calculating $$s_{in} = \Psi^T(\Psi\ \Psi^T)^{-1} A_{in};$$

and a warping and encoding unit which warps and encodes in space domain said input signals $s_{in}$ into said output vector $A_{out}$ of adapted output HOA coefficients by calculating $A_{out}=\Psi_2\ s_{in}$, wherein the mode vectors of the mode matrix $\Psi_2$ are modified with respect to the mode vectors of mode matrix $\Psi_1$ according to a warping function $f(\phi)$ by which the angles of the regularly postitoned loudspeaker positions are one-to-one mapped into the target angles of the target loudspeaker positions in said output vector $A_{out}$.

9. The apparatus of claim 8, comprising a weighting unit which weights said space domain input signals $s_{in}$ by a gain function $g(\phi)$ or $g(\theta,\phi)$ prior to said warping and encoding.

10. The apparatus of claim 9, wherein for two-dimensional Ambisonics said gain function is $$g(\phi) = \frac{d f(\phi)}{d\phi},$$

and for three-dimensional Ambisonics said gain function is $g(\theta,\phi)=$ $$g(\theta, \phi) = \frac{d f_\theta(\theta)}{d\theta} \cdot \frac{\arccos((\cos f_\theta(\theta_{in}))^2 + (\sin f_\theta(\theta_{in}))^2 \cos\phi_\varepsilon)}{\arccos((\cos\theta_{in})^2 + (\sin\theta_{in})^2 \cos\phi_\varepsilon)}$$

in the $\phi$ direction and in the $\theta$ direction, wherein $\phi$ is the azimuth angle, $\theta$ is the inclination angle, $f_\theta(\theta)$ is warping function for three-dimensional Ambisonics and $\phi_\epsilon$ is a small azimuth angle.

11. The apparatus of claim 8, comprising an extending unit which extends, prior to said decoding, the order or dimension of said input vector $A_{in}$ by adding zero coefficients for higher orders, in case the number or dimension $O_{warp}$ of virtual loudspeakers is equal or greater than the number or dimension $O_{in}$ of HOA coefficients.

12. The apparatus of claim 9, comprising a further weighting unit which further weights using a window vector w comprising zero coefficients for the highest orders said warped and encoded and possibly weighted signal $\Psi_2\ s_{in}$, and which strips part of the warped coefficients in order to provide said output vector $A_{out}$.

13. The apparatus of claim 9, comprising a unit for which commonly carries out said decoding, weighting and warping/decoding by using a size $O_{warp}\times O_{warp}$ transformation matrix $T=\mathrm{diag}(w)\,\Psi_2\,\mathrm{diag}(g)\Psi_1^{-1}$, wherein diag(w) denotes a diagonal matrix which has the values of said window vector w as components of its main diagonal and diag(g) denotes a diagonal matrix which has the values of said gain function g as components of its main diagonal.

14. The apparatus of claim 13 wherein, in order to shape said transformation matrix T so as to get a size $O_{out}\times O_{in}$, in said unit which commonly carries out said decoding, weighting and warping/decoding corresponding columns and/or lines of said transformation matrix T are removed so as to perform the space warping operation $A_{out}=T\,A_{in}$.

* * * * *